United States Patent [19]

Kos

[11] Patent Number: 4,909,408

[45] Date of Patent: Mar. 20, 1990

[54] VENTING SYSTEM FOR BEVERAGE CONTAINERS

[75] Inventor: Chester M. Kos, Cross Junction, Va.

[73] Assignee: Rubbermaid Commerical Products Inc., Winchester, Va.

[21] Appl. No.: 364,143

[22] Filed: Jun. 12, 1989

[51] Int. Cl.[4] ..... B65D 51/16

[52] U.S. Cl. ..... 220/366; 220/DIG. 27; 215/307

[58] Field of Search ..... 220/360, 367, 375, DIG. 27, 220/361, 363; 215/260, 270, 307, 354

[56] References Cited

U.S. PATENT DOCUMENTS

| | | | |
|---|---|---|---|
| 4,231,489 | 11/1980 | Malong | 220/366 |
| 4,427,126 | 1/1984 | Ostrowsky | 220/360 |
| 4,670,398 | 6/1987 | Song | 220/366 |
| 4,706,840 | 11/1987 | Thompson | 220/DIG. 27 |
| 4,747,502 | 5/1988 | Luenser | 220/366 |
| 4,763,804 | 8/1988 | O'Connell | 220/366 |
| 4,799,598 | 1/1989 | McFadyen | 215/260 |

*Primary Examiner*—Joseph Man-Fu Moy

*Attorney, Agent, or Firm*—Renner, Kenner, Greive, Bobak, Taylor & Weber

[57] ABSTRACT

A venting structure (14) for an enclosed fluid container (10) includes a tubular shank (16) projecting through an aperture in the cover (11) of the container (10). A baffle wall (26) closes the upper end of the shank (16) and has a central vent hole (27) therein. A cap (30) is removeably secured to the upper portion of the shank (16) and has interior walls forming an expansion chamber (34) with a slotted bottom wall. The upper portion of the shank (16) is provided with exterior longitudinal channels (29) which extend below the bottom of the cap so that the expansion chamber may communicate with the atmosphere.

12 Claims, 4 Drawing Sheets

VENTING SYSTEM FOR BEVERAGE CONTAINERS

TECHNICAL FIELD

The invention relates generally to venting system for enclosed fluid containers and more particularly to venting systems for portable beverage containers.

BACKGROUND OF THE INVENTION

Vent openings for enclosed beverage containers to equalize internal pressures with outer or atmospheric pressures are well known. However, they have certain disadvantages. The vent opening must be small to limit possible leakage, and hence it often becomes plugged and rendered inoperative. Also, where the enclosed container is filled with very hot air or steam generated by hot tea or coffee, for example, the person carrying the container or pouring liquid therefrom might well be burned by the escaping gas or stream. Protective caps covering the exterior of the vent opening have been used, with limited success, as hot steam escaping from under the cap can still cause injury.

One such protective cap arrangement is disclosed in U.S. Pat. No. 3,064,668, issued Nov. 20, 1962. The cap has a stem extending through an outer wall of the container, with an axial bore extending through the stem and into a chamber in which a ball valve normally covers a vent hole in the bottom wall of the chamber and aligned with the bore. The upper end of the bore is in the outer cap and is connected with downwardly inclined exhaust channels opening out under the rim of the cap.

This prior venting system has certain disadvantages. Equalization of internal and external pressures is accomplished only when the container is tilted to roll the ball off the lower hole. Otherwise, when the internal pressure is lower than the outer atmosphere, inward flow is shut off by the ball over the lower hole. If the internal pressure increases, it forces the ball against the lower end of the bore, shutting off the outer atmosphere. Hence, internal pressure can build up in the ball chamber so that when tilted, the ball may not roll to open the bore or if opened, very hot blasts of steam may be exhausted from the cap.

SUMMARY OF THE INVENTION

The invention comprises a novel venting system for insulated and preferably portable beverage containers, which system provides continuous venting to equalize internal and external pressures.

It is thus an object of the present invention to provide an improved venting system having novel means to produce continuous venting for liquid containers to equalize internal and external pressures.

Another object of the present invention is to provide novel means to disrupt the flow of exhaust fluid through the venting system.

A further object of the present invention is to provide a novel expansion chamber acting in conjunction with the disrupting means to further reduce the pressure of exhausting fluid.

These and other objects are accomplished by the improved venting system of the present invention, a preferred embodiment thereof being shown herein by way of example. Various modifications and changes in details of construction are comprehended within the scope of the appended claims.

In general, a venting structure for an enclosed fluid container includes a tubular shank projecting through an aperture in the cover of the container. A baffle wall closes the upper end of the shank and has a central vent hole therein. A cap is removeably secured to the upper portion of the shank and has interior walls forming an expansion chamber with a slotted bottom wall. The upper portion of the shank is provided with exterior longitudinal channels which extend below the bottom of the cap so that the expansion chamber may communicate with the atmosphere.

DESCRIPTION OF A PREFERRED EMBODIMENT

Figure 1:
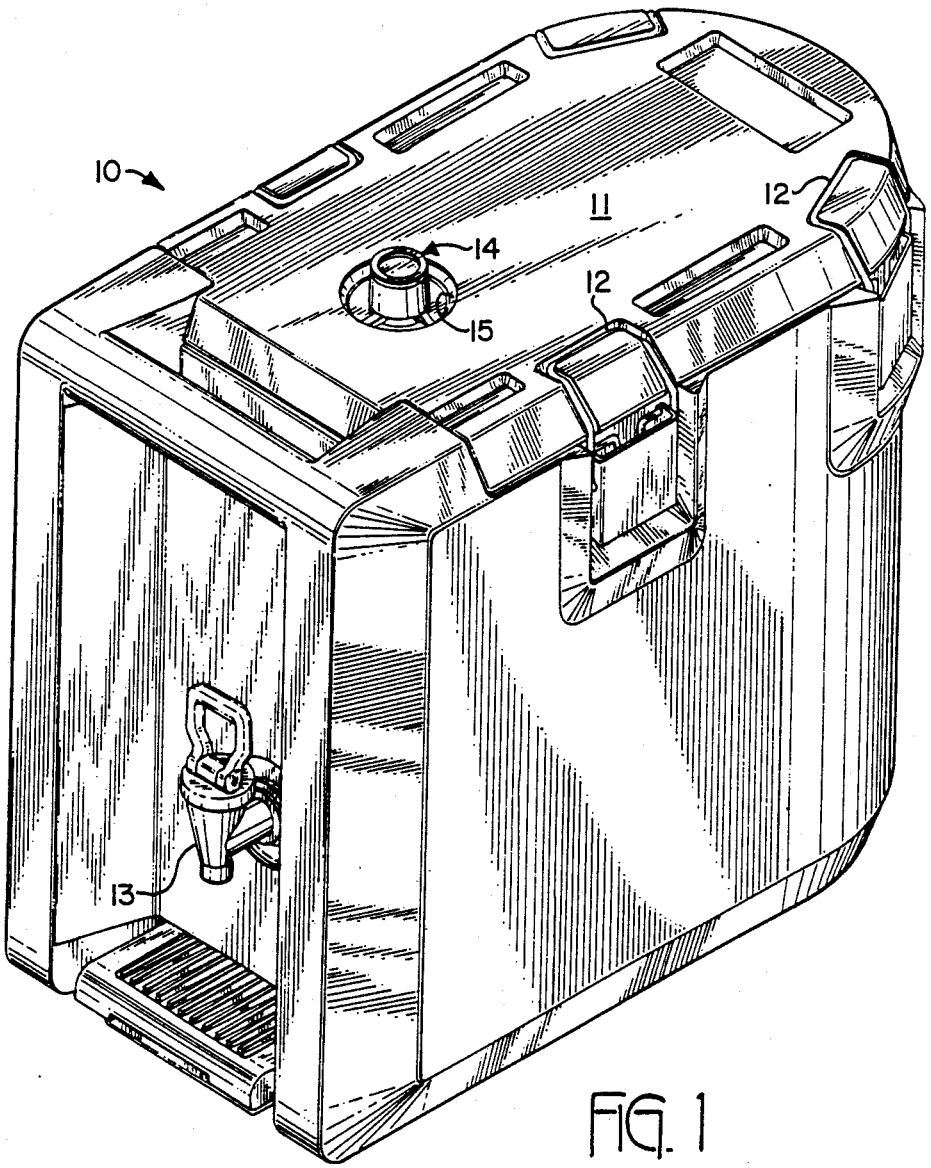
FIG. 1 is a perspective view of a beverage container having the improved venting structure.
Figure 2:
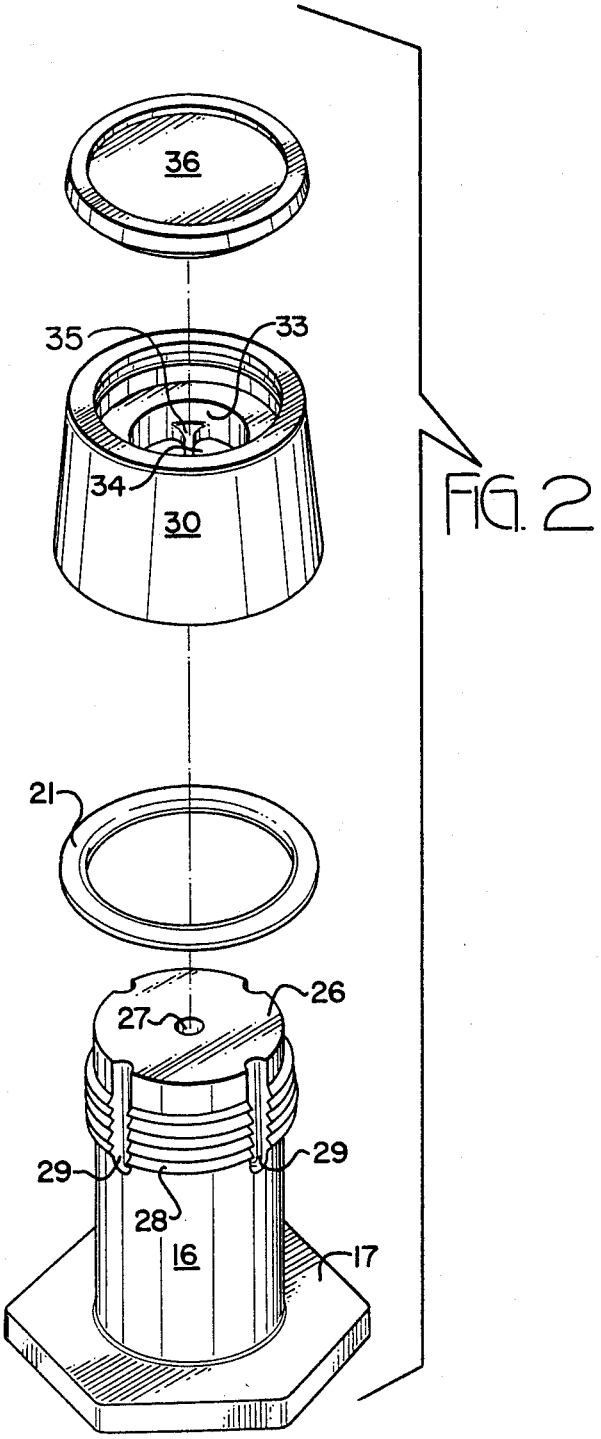
FIG. 2 is an enlarged exploded perspective view of the parts of the improved venting structure.
Figure 6:
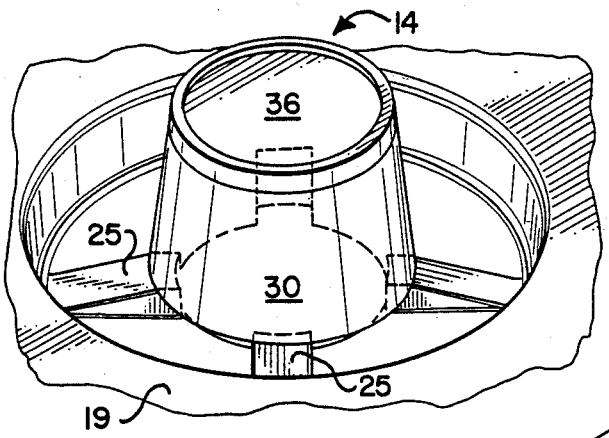
FIG. 6 is top plan perspective view showing the venting structure in place in the broken away cover of the container.
Figure 4:
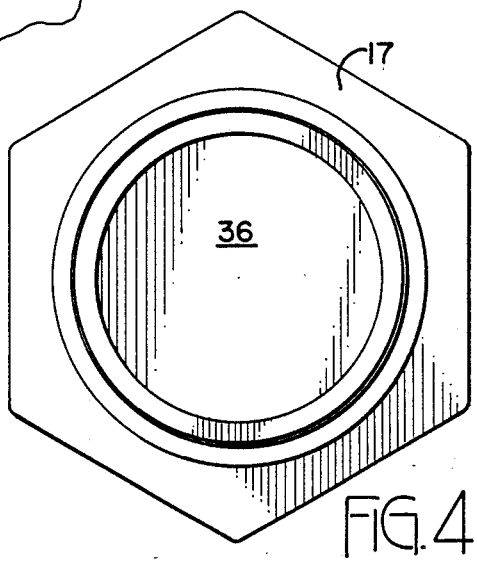
FIG. 4 is a top view of the improved venting structure.
Figure 3:
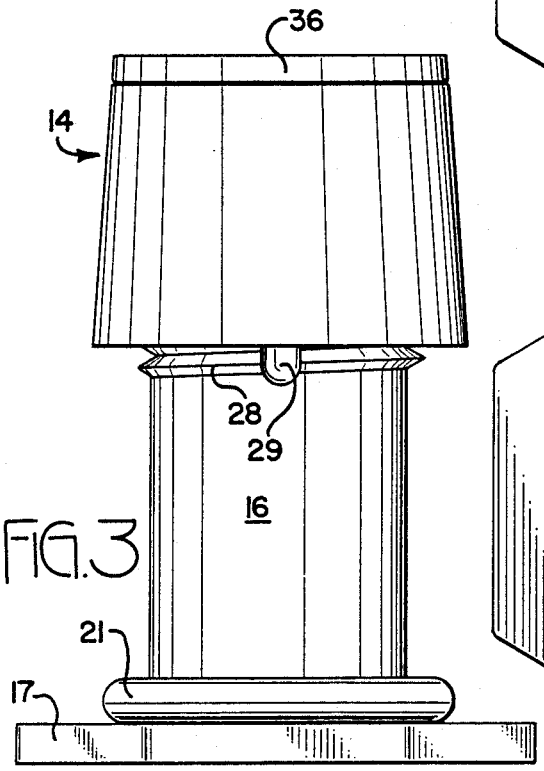
FIG. 3 is side elevation of the assembled parts of the improved venting structure.
Figure 5:
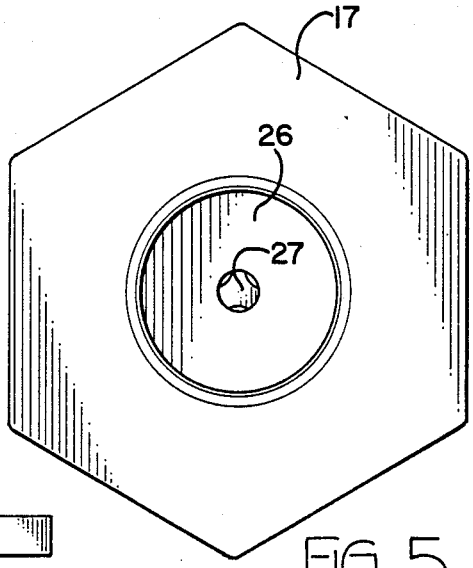
FIG. 5 is a bottom view of the improved venting structure.
Figure 7:
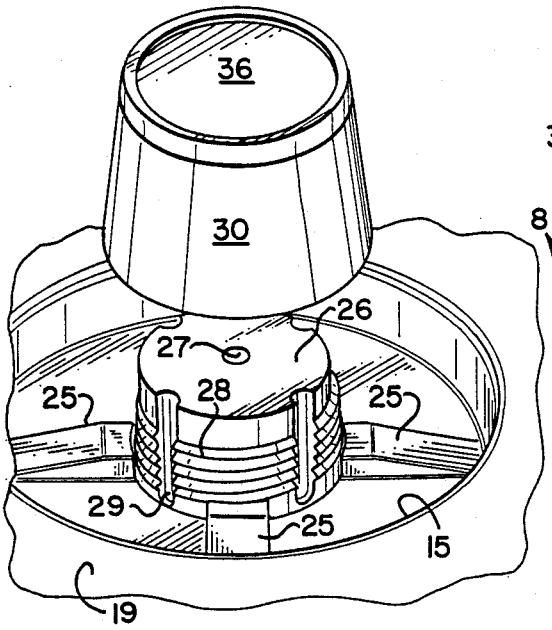
FIG. 7 is an exploded view of that which is shown in FIG. 6.
Figure 9:
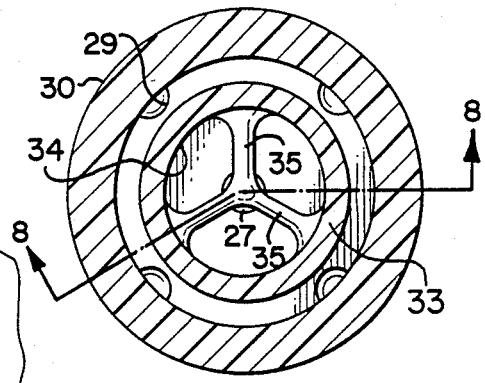
FIG. 9 is a cross-sectional view taken substantially along line 9—9 of FIG. 8.

A beverage container is indicated generally by the numeral 10 in FIG. 1, and has a removable cover 11 held in closed position by clamps 12, and a pouring spout 13 in one end wall. The improved venting structure indicated generally at 14, is preferably mounted within a circular recess 15 in the cover.

The venting structure 14 includes a tubular shank 16, preferably of molded polypropylene, and having a hexagonal flange 17 on its lower end. The cover 11, as well as the walls of the container, are preferably insulated, having inner and outer walls 18 an 19, respectively, with flange 17 of the tubular vent shank 16 being designed to fit within a recess 20 in the inner wall of the cover 11 when the shank is inserted through the tubular opening formed by the cylindrical wall 22 connecting the walls 23 and 24 of the recesses 20 and 15, respectively. An O-ring 21 encircles shank 16 and provides a seal between flange 17 and recess 20. Four equally radial inclined ribs 25 are formed on the upper or outer surface of recess wall 24 surrounding the tubular opening formed by tubular wall 22, for a purpose to be hereinafter described.

When inserted, the tubular shank 16 projects above the recess wall 24 and its upper end is enclosed by a top baffle wall 26 having a small center hole 27 therethrough. The projecting part of shank 16 has an exterior helical screw thread 28 formed thereon with four vertical equally spaced grooves 29 intersecting the thread. A cup-shaped cap 30 having an interior thread 31 is adapted to be screwed onto the shank and pull the lower flange 17 into the recess 20. O-ring 21 provides a seal between the shank and the wall 22 of the opening to prevent the escape of gases from the container.

Preferably, the cap is molded of polypropylene and has an interior wall flange 33 forming a chamber 34 above the baffle 26. The bottom of the opening is spanned by three equally spaced deflector prongs or ribs 35 extending inwardly from wall 33 and forming a grid or slotted bottom wall of the chamber 34. A closure lid 36 of polypropylene has a dependent circumferential flange 37 with an outer rib 38 thereon which snap-fits into and tightly closes the upper end of the tubular cap. The chamber 34 together with the space under the lid 36 provides an expansion or decompression chamber for air or gas escaping through the vent hole 27 in baffle 26. When the cap 30 is screwed down so that its bottom rim abuts the ribs 25 in the container recess 15, the deflector bottom of the interior opening is preferably spaced no more than 1/32 inch above the vent hole 27 in baffle 26.

Figure 8:
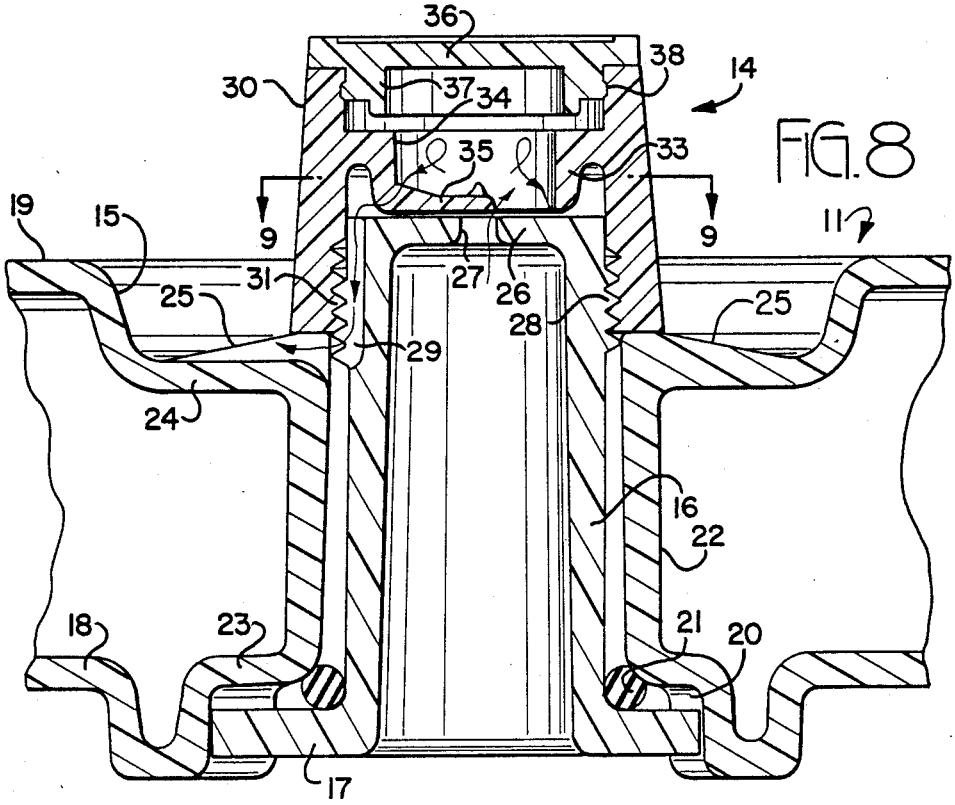
FIG. 8 is a vertical sectional view of the venting structure assembled and in place in the cover.

In operation, the improved venting structure provides for a continuous baffle passage of air or gas insuring a continuous equalization of pressure between the interior of the container and the outer atmosphere. Referring to FIG. 8, as indicated by the arrows, if the pressure in the container is or becomes greater than atmospheric, air will flow through vent hole 27, be deflected or disrupted by ribs 35 as it passes into expansion chamber 34 where the pressure is reduced, then passes downwardly past the deflector ribs 35 and through the groove channels 29, and thence out between container ribs 25 to atmosphere. Obviously, if the air pressure in the container is below atmospheric, air flow is reversed until the interior pressure is equalized.

The parts of the improved venting structure and the clearances when assembled are carefully designed so that no opening larger than 1/32 inch is presented to the outer atmosphere. Hence, there is minimal leakage of the liquid from the container and continuous pouring of its contents when desired is insured thereby accomplishing the objects of the invention and substantially improving the art.

I claim:

1. A venting structure for an enclosed fluid container comprising a tubular shank adapted for projecting through an aperture in the cover of the container;

a baffle wall closing the upper end of said shank and having a central vent hole therein;

a tubular cap detachably secured to and surrounding the upper end portion of said shank;

said cap having interior walls forming an expansion chamber with a slotted bottom wall;

the upper portion of said shank having exterior longitudinal channels extending below the bottom of said cap to provide communication between said expansion chamber and the atmosphere.

2. A venting structure according to claim 1, wherein said tubular shank has an exterior bottom flange for abutting the interior surface of the container wall.

3. A venting structure according to claim 2, wherein the upper end portion of said shank has exterior screw threads below said baffle wall.

4. A venting structure according to claim 3, wherein a closure lid is detachably snapped on the upper end of said tubular cap.

5. A venting structure according to claim 4, wherein said longitudinal channels in said shank extend through said exterior screw threads and below said cap.

6. A venting structure according to claim 1, wherein the upper end portion of said shank has exterior screw threads below said baffle wall.

7. A venting structure according to claim 6, wherein a closure lid is detachably snapped on the upper end of said tubular cap.

8. A venting structure according to 7, wherein said longitudinal channels in said shank extend through said exterior screw threads and below said cap.

9. A venting structure according to claim 1, wherein said slotted bottom wall is closely spaced above said baffle wall.

10. A venting structure according to claim 9, wherein the upper end portion of said shank has exterior screw threads below said baffle wall.

11. A venting structure according to claim 10, wherein a closure lid is detachably snapped on the upper end of said tubular cap.

12. A venting structure according to claim 11, wherein said longitudinal channels in said shank extend through said exterior screw threads and below said cap.

* * * * *